US007918286B2

(12) United States Patent
Nagasaka et al.

(10) Patent No.: US 7,918,286 B2
(45) Date of Patent: Apr. 5, 2011

(54) IMPACT TOOL

(75) Inventors: Hidenori Nagasaka, Anjo (JP); Tomonobu Nashimoto, Anjo (JP)

(73) Assignee: Makita Corporation, Anjo (JP)

( * ) Notice: Subject to any disclaimer, the term of this patent is extended or adjusted under 35 U.S.C. 154(b) by 114 days.

(21) Appl. No.: 12/382,273

(22) Filed: Mar. 12, 2009

(65) Prior Publication Data

US 2009/0242222 A1 Oct. 1, 2009

(30) Foreign Application Priority Data

Mar. 25, 2008 (JP) ..... 2008-078613

(51) Int. Cl.
*B25D 15/00* (2006.01)

(52) U.S. Cl. ..... 173/93; 173/109; 173/93.6

(58) Field of Classification Search ..... 173/109, 173/93, 93.6, 104, 112
See application file for complete search history.

(56) References Cited

U.S. PATENT DOCUMENTS

| | | | | |
|---|---|---|---|---|
| 3,841,418 | A * | 10/1974 | Biersack | 173/109 |
| 5,601,149 | A * | 2/1997 | Kawasaki et al. | 173/93.5 |
| 5,673,758 | A * | 10/1997 | Sasaki et al. | 173/178 |
| 7,048,075 | B2 * | 5/2006 | Saito et al. | 173/93.5 |
| 7,410,007 | B2 * | 8/2008 | Chung et al. | 173/48 |
| 7,416,031 | B2 * | 8/2008 | Murakami et al. | 173/211 |
| 2008/0035360 | A1 * | 2/2008 | Furuta | 173/104 |
| 2009/0038816 | A1 * | 2/2009 | Johnson et al. | 173/109 |
| 2009/0255699 | A1 * | 10/2009 | Lehnert et al. | 173/93.6 |

FOREIGN PATENT DOCUMENTS

JP A-2003-231067 8/2003

* cited by examiner

*Primary Examiner* — Brian D Nash
(74) *Attorney, Agent, or Firm* — Oliff & Berridge, PLC

(57) ABSTRACT

In an impact tool including a spindle, an anvil, and an impact mechanism having a hammer and a coil spring, a restricting portion is provided at a front surface of a large-diameter portion of the spindle so as to receive a rear end of the coil spring and to restrict an inner diameter of the rear end of the coil spring. A ring-shaped groove is formed at a rear surface of the hammer to receive a front end of the coil spring, in a manner which provides an inner cylindrical portion at a rear side of the hammer. A run-off portion is formed in the restricting portion so as to allow the inner cylindrical portion of the hammer to move thereinto, so that the hammer can move backward for a distance corresponding to a depth of the run-off portion.

13 Claims, 3 Drawing Sheets

IMPACT TOOL

BACKGROUND OF THE INVENTION

This application claims the entire benefit of Japanese Patent Application Number 2008-078613 filed on Mar. 25, 2008, the entirety of which is incorporated by reference.

1. Field of the invention

The present invention relates to an impact tool, such as an impact driver, which causes an anvil protruding from a front side of a housing to generate a rotary impact force.

2. Description of related art

As disclosed in Japanese Laid-open Patent Publication No. 2003-231067, an impact tool such as an impact driver includes: a spindle disposed in a housing and configured to be rotated by a motor; an anvil disposed in front of the spindle and rotatably supported in the housing in a manner coaxial with the spindle, a front end of the anvil having an insertion hole for attaching a bit and protruding from a front side of the housing; and an impact mechanism configured to transmit a rotation of the spindle as a rotary impact force to the anvil, and an action of the impact mechanism caused by a rotation of the spindle is transmitted to the anvil as a rotary impact force.

In this impact mechanism, the rear end of the spindle has a large-diameter portion for supporting planetary gears which are meshed with an output shaft of the motor. A hammer is fitted onto the spindle at a front side portion of the spindle via balls, which are received between longitudinal grooves formed on the inner surface of the hammer and cam grooves formed on the outer surface of the spindle. This configuration allows the hammer to be rotatable along with the spindle as well as to be movable in the front-and-rear direction with a predetermined stroke length. Further, a coil spring is positioned between the large-diameter portion at a rear side of the spindle and the hammer, so as to urge the hammer toward the advanced position at which the hammer is engaged with the anvil. It is noted that the front surface of the large-diameter portion of the spindle has a circular engagement projection which protrudes from a center of the front surface to receive the rear end of the coil spring. A washer is inserted onto the circular engagement projection so as to restrict the inner diameter of the coil spring at the rear end of the coil spring. Meanwhile, a ring-shaped groove is formed at the rear surface of the hammer to receive the front end of the coil spring. The front end of the coil spring is loosely fitted into the ring-shaped groove, so as to restrict the inner diameter of the coil spring at its front end.

When the motor is driven and the spindle rotates, a rotation of the spindle is transmitted to the hammer via the balls and causes the hammer to rotate, so that the anvil engaged with the hammer also rotates. Therefore, a screw-tightening operation, etc. can be performed using a bit attached to the front end of the anvil. As the screw-tightening operation proceeds and a load applied to the anvil increases to a certain threshold, the hammer retreats or moves backward along the cam grooves against the urging force of the coil spring. Once the hammer retreats and disengages from flanges of the anvil, the hammer is again advanced forward by the urging force of the coil spring while rotating along with the spindle. The hammer is then reengaged with the flanges of the anvil. Accordingly, the hammer moves back and forth repeatedly to repeat disengagement from and reengagement with the flanges of the anvil, so that an intermittent rotary impact force to the anvil is provided for a retightening function of the impact driver.

In this type of the impact tool, in order to improve usability and cost, there has been an increased need to reduce the size of the impact tool, especially the length along the axial direction of the anvil. However, as long as the impact tool includes the aforementioned impact mechanism, it is difficult to reduce the size of the impact tool. This is because the impact tool requires a space in the housing to house the impact mechanism including a space for a stroke movement of the hammer, and also because design variation for changing the mass of the hammer, the shape of the anvil, etc. will be restricted in order to ensure sufficient impacting capability.

In view of the above drawback of the prior art, the present invention seeks to provide an impact tool, which is simple in structure and can reduce the size of the impact tool along the axial direction of the anvil.

The present invention has been made in an attempt to eliminate the above disadvantages, and illustrative, non-limiting embodiments of the present invention overcome the above disadvantage and other disadvantages not described above. Also, the present invention is not required to overcome the disadvantage described above, and an illustrative, non-limiting embodiment of the present invention may not overcome any of the problems described above.

SUMMARY OF THE INVENTION

According to the present invention, there is provided an impact tool which comprises: a spindle disposed in a housing and configured to be rotated by a motor; an anvil disposed in front of the spindle and rotatably supported in the housing in a manner coaxial with the spindle, a front end of the anvil protruding from a front side of the housing; an impact mechanism comprising a hammer engageable with the anvil at its advanced position, and a coil spring, and configured to transmit a rotation of the spindle as a rotary impact force to the anvil, the hammer being fitted onto a front side portion of the spindle and rotatable along with the spindle via rolling elements while being allowed to move in a front-and-rear direction with a predetermined stroke length, and the coil spring being positioned between a large-diameter portion at a rear side of the spindle and the hammer so as to urge the hammer toward the advanced position; a restricting portion provided at a front surface of the large-diameter portion of the spindle, and configured to receive a rear end of the coil spring and to restrict an inner diameter of the rear end of the coil spring; and a ring-shaped groove formed at a rear surface of the hammer, and configured to receive a front end of the coil spring such that the front end of the coil spring is loosely fitted into the ring-shaped groove, so as to restrict an inner diameter of the front end of the coil spring, in a manner which provides an inner cylindrical portion at a rear side of the hammer, wherein a run-off portion is formed in the restricting portion so as to allow the inner cylindrical portion to move thereinto, so that the hammer can move backward for a distance corresponding to a depth of the run-off portion.

In the aforementioned impact tool, the restricting portion may comprise at least one engagement projection, which protrudes from the front surface of the large-diameter portion of the spindle corresponding to an inner diameter of the coil spring, and which is positioned without being overlapped with the inner cylindrical portion in such a position where the inner cylindrical portion goes into the run-off portion.

According to the present invention, because the run-off portion is formed on the front surface of the large-diameter portion of the spindle, the impact tool can be designed such that the impact mechanism is set back in consideration of the stroke length of the hammer. Therefore, it is possible to reduce the size of the impact tool along the axial direction of the anvil. Further, the impact tool according to the present invention can be achieved with a simple structure by providing the run-off portion, which can restrict an increase in the production cost.

In addition to the above advantageous effects of the present invention, if the restricting portion is formed as at least one engagement projection, the run-off portion is automatically formed inside the engagement projection(s). This can provide a simple and reasonably economical impact tool.

BRIEF DESCRIPTION OF THE DRAWINGS

The above aspect, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENTS

With reference to the accompanying drawings, the present invention will be described in detail.

Figure 1:
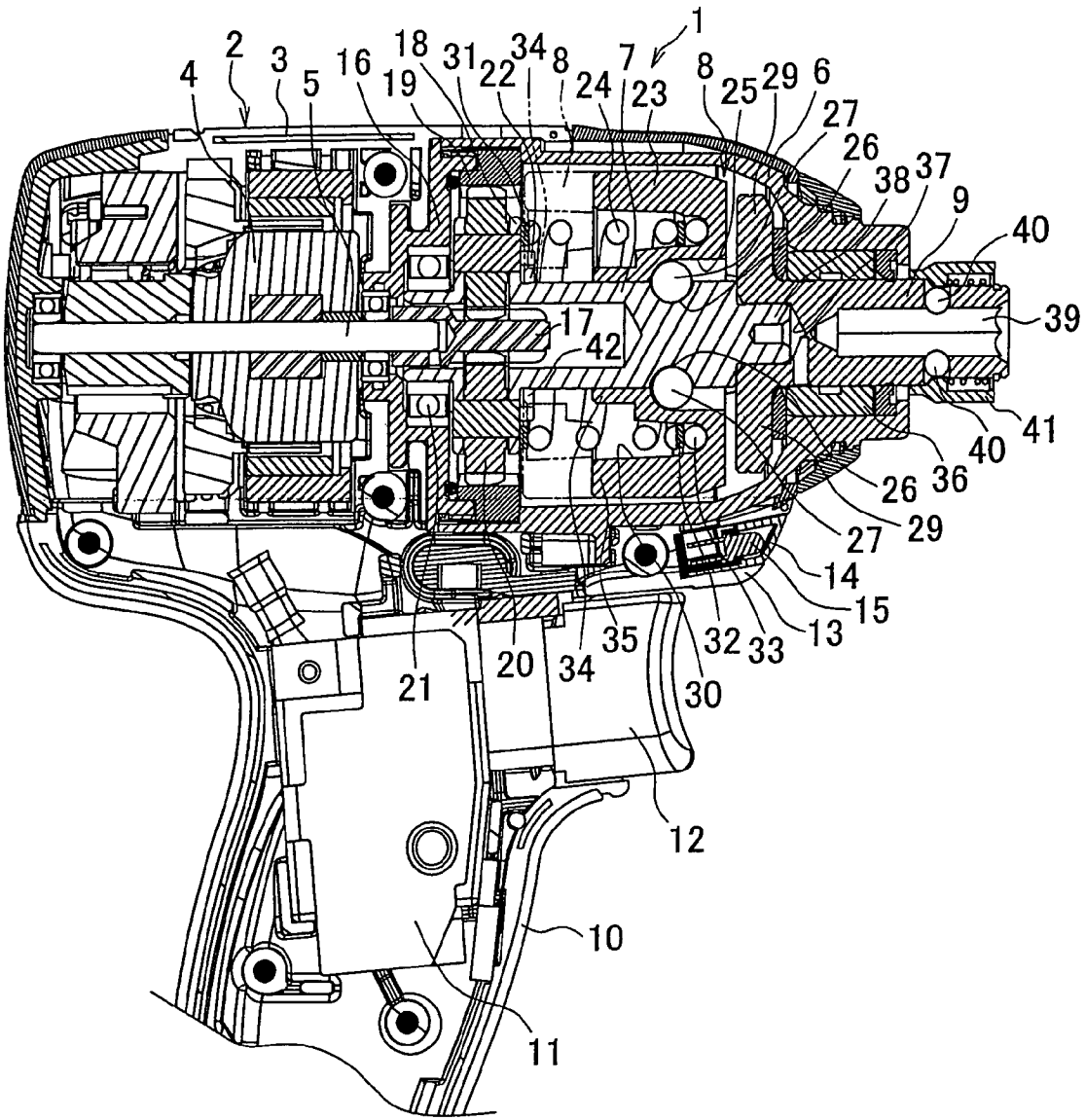
FIG. 1 is a longitudinal sectional view of an impact driver according to one exemplary embodiment of the present invention.
Figure 2:
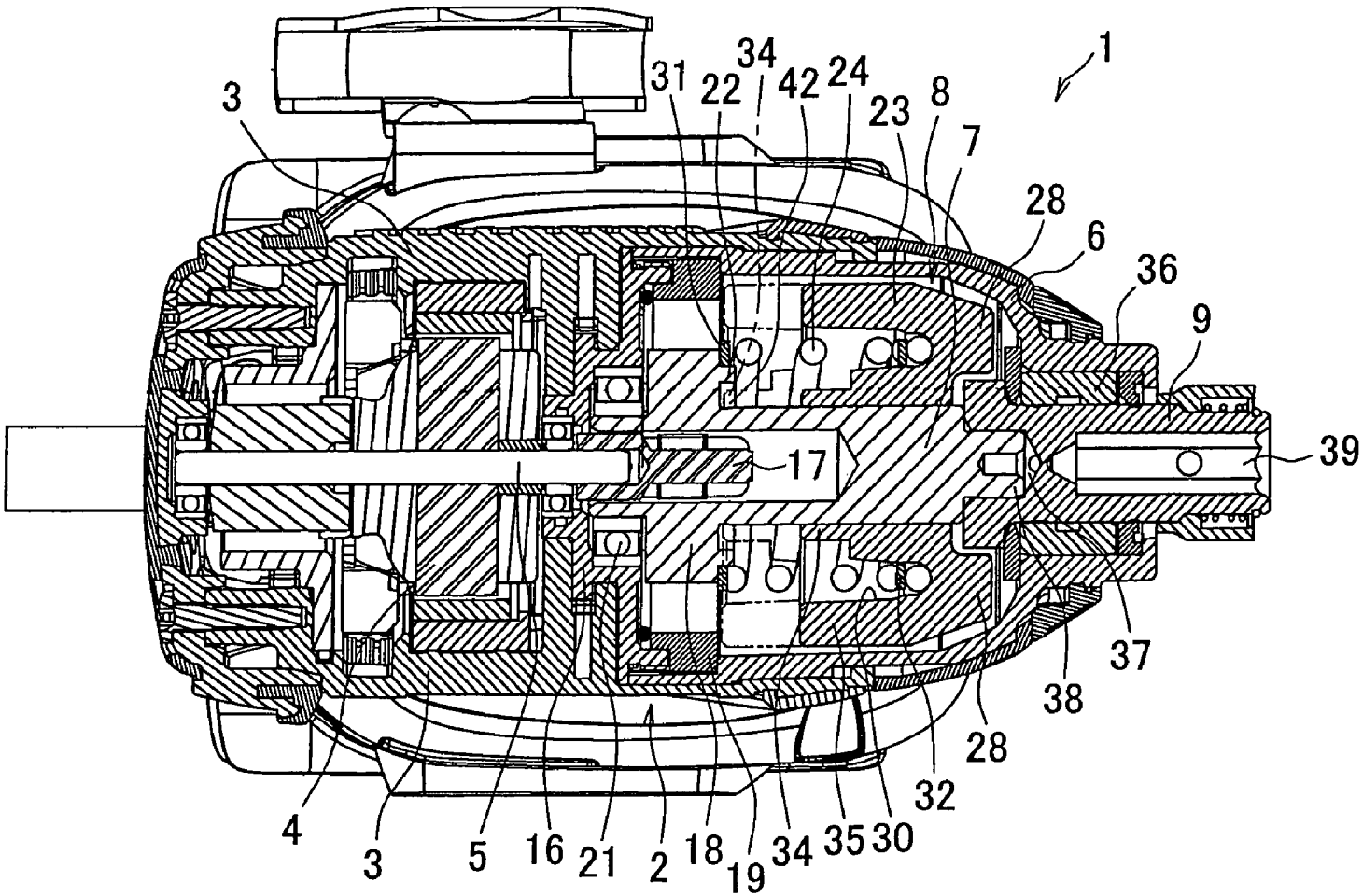
FIG. 2 is a transverse sectional view of the impact driver shown in FIG. 1.

An impact driver as an example of an impact tool will be described. As seen in FIGS. 1 and 2, an impact driver 1 includes: a main body housing 2 which is assembled from right and left housing halves 3, 3 and in which a motor 4 is disposed; and a hammer case 6 which is assembled to a front side (right-hand side of FIGS. 1 and 2) of the main body housing 2 and which receives therein a spindle 7, an impact mechanism 8, and an anvil 9. The hammer case 6 has a diving bell-shaped cross-section. Reference numeral 10 indicates a handle extending from a lower part of the main body housing 2. A battery pack (not shown) as a power source is attached to the lower end of the handle 10, and a switch 11 is disposed at an upper part of the handle 10. The switch 11 activates a motor 4 when a switch trigger 12 is depressed to ON position. An extension portion 13 for covering a lower part of the hammer case 6 is provided in the main body housing 2 above the switch trigger 12, and a lighting unit 14 including an LED 15, etc. is arranged inside the extension portion 13, facing the front side of the anvil 9.

Figure 3A:
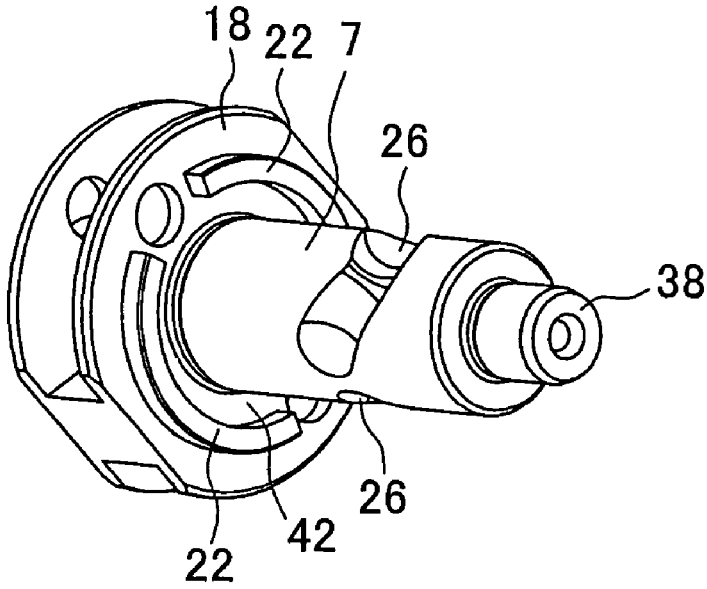
FIGS. 3A and 3B are perspective views showing a spindle of the impact driver as seen from different angles, respectively.
Figure 3B:
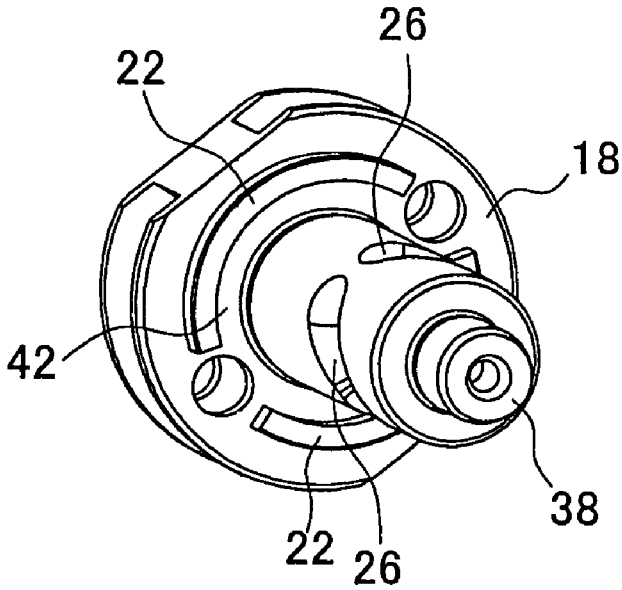

An output shaft 5 of the motor 4 is rotatably supported by a gear case 16 which is held to the main body housing 2. The front end of the output shaft 5 protrudes into the hammer case 6 and tightly fits onto a pinion 17. The spindle 7 is disposed in the hammer case 6. As best seen in FIG. 3, the spindle 7 has a disc-shaped large-diameter portion 18 at a rear side thereof. The large-diameter portion 18 of the spindle 7 holds two planetary gears 20, 20 which mesh with the pinion 17 and revolve within an internal gear 19. The rear end of the spindle 7 is rotatably supported by a ball bearing 21 in a manner coaxial with the output shaft 5, and the ball bearing 21 is supported by the gear case 16.

Provided at the front surface of the large-diameter portion 18 of the spindle 7 are a pair of arcuate engagement projections 22, 22 as a restricting portion. The engagement projections 22, 22 are provided symmetrically with respect to the axis of the spindle 7. The engagement projections 22, 22 (restricting portion) receive a coil spring 24 to be described later such that the rear end of the coil spring 24 is fitted onto the outer peripheral surfaces of the engagement projections 22, 22. Therefore, the engagement projections 22, 22 restrict an inner diameter of the rear end of the coil spring 24.

The impact mechanism 8 includes a hammer 23 fitted at a front side portion of the spindle 7, and the coil spring 24 positioned between the hammer 23 and the large-diameter portion 18 so as to urge the hammer 23 toward its advanced position.

The hammer 23 has a pair of longitudinal grooves 25, 25, which are formed on the inner surface of the hammer 23 and extend from the front end toward the rear end of the hammer 23. V-shaped cam grooves 26, 26 are formed on the outer surface of the spindle 7 corresponding to the longitudinal grooves 25, 25. The hammer 23 is engaged with the spindle 7 via balls 27, 27 as rolling elements, which are received between the longitudinal grooves 25, 25 and the V-shaped cam grooves 26, 26. A pair of engagement portions 28, 28 protrude from the front surface of the hammer 23. By engaging these engagement portions 28, 28 with flanges 29, 29 provided at the rear end of the anvil 9, torque is transmitted from the spindle 7 to the anvil 9.

The coil spring 24 is positioned in a predetermined position and the inner diameter of the coil spring 24 is constrained. To be more specific, the rear end of the coil spring 24 is fitted onto the engagement projections 22, 22 formed on the front surface of the large-diameter portion 18 of the spindle 7, so that positioning of the coil spring 24 and restriction of the inner diameter of the coil spring 24 can be performed at the rear end of the coil spring 24. Meanwhile, the front end of the coil spring 24 is loosely fitted into a ring-shaped groove 30, which is formed at the rear surface of the hammer 23 in a manner coaxial with the hammer 23, so that positioning of the coil spring 24 and restriction of the inner diameter of the coil spring 24 can be performed at the front end of the coil spring 24. Reference numeral 31 indicates a rear washer, which is fitted onto the outer peripheries of the engagement projections 22, 22 and receives the rear end of the coil spring 24. Reference numeral 32 indicates a front washer, which is supported at the bottom portion of the ring-shaped groove 30 via balls 33, 33 and receives the front end of the coil spring 24. The ring-shaped groove 30 provides an inner cylindrical portion 34 in a manner which is positioned inside the coil spring 24, and an outer cylindrical portion 35 in a manner which is positioned outside the coil spring 24, respectively. The inner cylindrical portion 34 and the outer cylindrical portion 35 are formed at the rear side of the hammer 23 with the ring-shaped groove 30 interposed therebetween. It is noted that the rear end of the inner cylindrical portion 34 has the outer diameter smaller than the diameter of a circle defined by the inner peripheral surfaces of the engagement projections 22, 22, so that the engagement projections 22, 22 are not overlapped with the rear end of the inner cylindrical portion 34 as viewed from the axial direction of the spindle. In other words, the engagement projections 22, 22 are positioned without being overlapped with the inner cylindrical portion 34 in such a position where the inner cylindrical portion 34 goes into a run-off portion to be described later.

The anvil 9 is rotatably supported at an intermediate portion thereof by a metal bearing 36 which is held at a front end portion of the hammer case 6. A bearing hole 37 is formed at the rear end of the center axis of the anvil 9, and rotatably supports a small-diameter portion 38 provided at the front side of the spindle 7. At the front end of the anvil 9 which protrudes from the hammer case 6, an insertion hole 39 for attaching a bit (not shown) is formed while a chuck mechanism including balls 40, 40, a sleeve 41, etc. is provided in order to prevent the bit inserted into the insertion hole 39 from coming off from the anvil 9.

According to the impact driver 1 as described above, when the switch trigger 12 is operated so as to activate the motor 4 to rotate. The rotation of the output shaft 5 of the motor 4 is then transmitted to the spindle 7 via the planetary gears 20, 20, so that the spindle 7 rotates. The rotation of the spindle 7 is then transmitted to the hammer 23 via the balls 27, 27 and causes the hammer 23 to rotate. Because the hammer 23 is engaged with the flanges 29, 29 of the anvil 9 via the engagement portions 28, 28, the anvil 9 also rotates by the rotation of the hammer 23. Therefore, a screw-tightening operation, etc. can be performed using a bit attached to the front end of the anvil 9.

As the screw-tightening operation proceeds and a load applied to the anvil 9 increases to a certain threshold, the rotation of the anvil 9 cannot follow the rotation of the spindle 7, and then the hammer 23 retreats or moves backward against the urging force of the coil spring 24 while the balls 27, 27 positioned at the rear end of the longitudinal grooves 25, 25 of the hammer 23 are displaced rearward along the cam grooves 26, 26 of the spindle 7. When the hammer 23 retreats and the engagement portions 28, 28 of the hammer 23 are disengaged from the flanges 29, 29 of the anvil 9, the balls 27, 27 are forced to rotate by the urging force of the coil spring 24 and move forward along the cam grooves 26, 26, so that the engagement portions 28, 28 of the hammer 23 are reengaged with the flanges 29, 29 of the anvil 9 to transmit a rotary impact force to the anvil 9. The retreating and advancing movements of the hammer 23 are repeated, and the engagement portions 28, 28 of the hammer 23 are repeatedly disengaged from and reengaged with the flanges 29, 29 of the anvil 9 to provide an intermittent rotary impact force. This intermittent rotary impact force provides a retightening function of the impact driver 1.

It should be noted that a run-off portion 42 is formed inside the engagement projections 22, 22 at the front surface of the large-diameter portion 18 of the spindle 7 so as to allow the inner cylindrical portion 34 of the hammer 23 to move into the run-off portion 42. This enables to set back the retreated position of the hammer 23, as shown in double-dashed chain lines of FIGS. 1 and 2, to such a position where the rear surface of the inner cylindrical portion 34 goes into the run-off portion 42 beyond the front end surfaces of the engagement projections 22, 22. In other words, the retreated position of the hammer 23 can be set back for a distance corresponding to the depth of the run-off portion 42. According to this configuration of the run-off portion 42, it is possible to set back the impact mechanism 8 without reducing the stroke length of the hammer 23. Therefore, the whole length of the impact driver 1 can be reduced along the axial direction of the anvil 9.

According to the impact driver 1 as described above in this embodiment, the run-off portion 42 is formed inside the engagement projections 22, 22 so that the inner cylindrical portion 34 formed inside the ring-shaped groove 30 at the rear side of the hammer 23 is allowed to move into the run-off portion 42, and therefore the retreated position of the hammer 23 can be set back for a distance corresponding to the depth of the run-off position 42. This enables to design the impact driver 1 such that the impact mechanism 8 is set back in consideration of the stroke length of the hammer 23. Therefore, it is possible to reduce the size of the impact tool I along the axial direction of the anvil 9. Further, the impact driver 1 according to this embodiment can be achieved with a simple structure by providing the run-off portion 42, which can restrict an increase in the production cost.

Especially, in this embodiment, the restricting portion is formed as engagement projections 22, 22, which are provided at the front surface of the large-diameter portion 18 corresponding to the inner diameter of the coil spring 24 and which are positioned without being overlapped with the inner cylindrical portion 34 of the hammer 23 in such a position where the inner cylindrical portion 34 goes into the run-off portion 42. Therefore, the run-off portion 42 is automatically formed inside the engagement projections 22, 22, leading to a simple and reasonably economical impact driver.

Although the present invention has been described in detail with reference to the above preferred embodiment, the present invention is not limited to the above specific embodiment and various changes and modifications may be made without departing from the scope of the appended claims. For example, the number of engagement projections 22 is not limited to two, and three or more engagement projections 22 may be provided by reducing the circumferential length of each engagement projection 22. On the contrary, a ring-shaped engagement projection may be employed. Further, the restricting portion is not limited to one or more engagement projections, and may be a plurality of short plate members or prongs which are arranged on the circumference of a circle at predetermined intervals so that the rear end of the coil spring 24 is inserted onto the plate members or prongs to restrict the inner diameter of the coil spring 24. This can also provide a run-off portion inside the plate members or prongs.

Further, it is not necessary that the housing includes the main body housing 2 and the hammer case 6. As an alternative, an integrated housing may be employed, in which the main body housing and the hammer case are integrated. Also, the housing may not include an extension portion. Changes or modifications may also be made to other parts except for the impact mechanism where necessary. Of course, the present invention is not limited to an impact driver, and is applicable to other impact tools such as an angle impact driver and an impact wrench.

What is claimed is:

1. An impact tool comprising:

a spindle disposed in a housing and configured to be rotated by a motor;

an anvil disposed in front of the spindle and rotatably supported in the housing in a manner coaxial with the spindle, a front end of the anvil protruding from a front side of the housing;

an impact mechanism comprising a hammer engageable with the anvil at its advanced position, and a coil spring, and configured to transmit a rotation of the spindle as a rotary impact force to the anvil, the hammer being fitted onto the spindle at a front side portion of the spindle and rotatable along with the spindle via rolling elements while being allowed to move in a front-and-rear direction with a predetermined stroke length, and the coil spring being positioned between a large-diameter portion at a rear side of the spindle and the hammer so as to urge the hammer toward the advanced position;

a restricting portion protruding from a front surface of the large-diameter portion of the spindle, and configured to receive a rear end of the coil spring and to restrict an inner diameter of the rear end of the coil spring; and a ring-shaped groove formed at a rear surface of the hammer, and configured to receive a front end of the coil spring such that the front end of the coil spring is loosely fitted into the ring-shaped groove, so as to restrict an inner diameter of the front end of the coil spring, in a manner which provides an inner cylindrical portion at a rear side of the hammer, wherein a run-off portion having a depth defined by a protrusion of the restricting portion is formed in the restricting portion so as to allow the inner cylindrical portion of the hammer to move thereinto, so that the hammer can move backward for a distance corresponding to the depth of the run-off portion.

2. An impact tool according to claim 1, wherein the restricting portion comprises at least one engagement projection, which protrudes from the front surface of the large-diameter portion of the spindle corresponding to an inner diameter of the coil spring, and which is positioned without being overlapped with the inner cylindrical portion in such a position where the inner cylindrical portion goes into the run-off portion.

3. An impact tool according to claim 2, wherein a pair of engagement projections are provided symmetrically with respect to an axis of the spindle.

4. An impact tool according to claim 1, wherein a washer is fitted onto an outer periphery of the restricting portion at the large-diameter portion of the spindle, so as to receive the rear end of the coil spring.

5. An impact tool according to claim 1, wherein a washer for receiving the front end of the coil spring is supported at a bottom portion of the ring-shaped groove of the hammer via a plurality of balls.

6. An impact tool according to claim 1, wherein a pair of longitudinal grooves extending in a front-and-rear direction are formed on an inner surface of the hammer, and V-shaped cam grooves are formed on an outer surface of the spindle, and wherein the hammer is engaged with the spindle via the rolling elements, which are received between the longitudinal grooves and the V-shaped cam grooves.

7. An impact tool according to claim 6, wherein the rolling elements are balls.

8. An impact tool according to claim 1, wherein a pair of engagement portions are provided at a front surface of the hammer, and wherein torque is transmitted to the anvil by engaging the engagement portions with a pair of flanges provided at a rear end of the anvil.

9. An impact tool according to claim 1, wherein the housing comprises a main body housing in which the motor is disposed, and a hammer case assembled to a front side of the main body housing and configured to receive the spindle, the impact mechanism, and the anvil.

10. An impact tool according to claim 9, wherein an intermediate portion of the anvil is rotatably supported by a bearing which is held at a front end portion of the hammer case, and wherein a bearing hole is formed at a rear end of a center axis of the anvil, and a small-diameter portion provided at a front side of the spindle is rotatably supported in the bearing hole.

11. An impact tool according to claim 9, wherein an extension portion for covering a lower part of the hammer case is provided in the main body housing, and wherein a lighting unit is arranged inside the extension portion to illuminate a front side of the anvil with light.

12. An impact tool according to claim 1, wherein an insertion hole for attaching a bit is formed in a front end of the anvil, and a chuck mechanism is provided at a front side of the anvil so as to prevent a bit inserted into the insertion hole from coming off from the anvil.

13. An impact tool according to claim 1, wherein the spindle is rotatably supported in a manner coaxial with an output shaft of the motor, and wherein the large-diameter portion of the spindle retains a plurality of planetary gears, which mesh with a pinion provided on the output shaft and revolve within an internal gear held in the housing.

* * * * *